United States Patent [19]

Saron

[11] 4,347,553

[45] Aug. 31, 1982

[54] FLEXIBLE LIGHT WITH PROTECTIVE CAP

[76] Inventor: John R. Saron, 6638 Mango South, St. Petersburg, Fla. 33707

[21] Appl. No.: 314,721

[22] Filed: Oct. 26, 1981

[51] Int. Cl.[3] ..... F21L 3/00

[52] U.S. Cl. ..... 362/189; 362/186; 362/202; 362/206; 362/278; 362/295

[58] Field of Search ..... 362/109, 119, 186, 189, 362/194, 196, 198, 199, 202, 205, 206, 295, 278

[56] References Cited

U.S. PATENT DOCUMENTS

| | | | |
|---|---|---|---|
| 1,988,961 | 1/1935 | Prideaux | 362/189 X |
| 2,247,258 | 6/1941 | Shepard | 362/109 X |
| 2,483,820 | 10/1949 | Falge | 362/189 |
| 2,632,094 | 3/1953 | Akerley | 362/189 |
| 2,681,979 | 6/1954 | Manoloff | 362/186 X |
| 3,624,382 | 11/1971 | White | 362/119 |
| 3,711,703 | 1/1973 | Bacevius | 362/189 |
| 3,717,759 | 2/1973 | Rousseau | 362/186 |
| 3,737,655 | 6/1973 | Blendinger et al. | 362/32 X |
| 4,027,150 | 5/1977 | Dean | 362/186 |
| 4,187,532 | 2/1980 | Naffier | 362/186 |

FOREIGN PATENT DOCUMENTS

| | | | |
|---|---|---|---|
| 604486 | 8/1960 | Canada | 362/202 |

*Primary Examiner*—Peter A. Nelson

[57] ABSTRACT

A reusable light comprising a housing configured to operatively retain a voltage source therein having an extended bulb assembly mounted on one end thereof and a switch pivotally mounted on the opposite end thereof, the extended bulb assembly comprises an enlongated hollow sleeve having a mounting member attached on one end thereof to attach the extended bulb assembly to the housing and a bulb housing having a light source disposed therein attached to the opposite end thereof, a first conductor including a first and second conductor element extending substantially the length of the flexible light coupled to the light source, a second conductor disposed within the hollow sleeve being coupled to another portion of the light source and a removable cap to selectively house the extended bulb assembly, the switch movable to operatively engage the first conductor means to selectively close the circuit and activate the light source.

9 Claims, 2 Drawing Figures

FLEXIBLE LIGHT WITH PROTECTIVE CAP

BACKGROUND OF THE INVENTION

1. Field of the Invention

A reusable flexible light comprising a housing configured to operatively retain a voltage source therein including an extended bulb assembly mounted on one end thereof and a switch pivotally attached to the opposite end thereof to electrically couple the voltage source to the extended bulb assembly.

2. Description of the Prior Art

Numerous flexible lights have been designed for medical use and similar endeavors. Naturally, these lights include a voltage source and light source with a switch means to energize the light. These lights may include extended flexible lights to permit illumination of relatively small areas. Unfortunately, many such flexible lights are complicated to manufacture and assemble.

Thus a need exists for a simple and reliable device including an integral light source/voltage source package.

Examples of prior art are disclosed in U.S. Pat. Nos.: 936,499; 1,158,600; 2,427,890; 3,111,277; and 3,881,468.

SUMMARY OF THE INVENTION

The present invention relates to a reusable flexible light comprising a housing having an extended bulb assembly and switch mounted at opposite ends thereof. A removable protective cap is removably mounted on the housing to protect the extended bulb assembly when the flexible light is not in use.

The housing includes a retainer lip and switch retainer operatively coupling the extended bulb assembly and switch thereto. A voltage source comprising one or more batteries is operatively retained within the cylindrical housing.

The extended bulb assembly comprises an elongated sleeve having a mounting member attached to one end thereof to attach the extended bulb assembly to the housing and a bulb housing having a light source disposed therein attached to the opposite end thereof.

A first conductor electrically coupled between the light source and switch extends substantially the entire length of the flexible light. A second conductor extends between the voltage source and the light source.

The switch pivotally mounted, comprises an arcuate cam member and a switch contact. As described more fully hereinafter, the switch contact is movable between a first and second position to operatively engage and disengage the first conductor to actuate and deactuate the flexible light.

When not in use, the removable protective cap is mounted onto the housing to enclose the extended bulb assembly. The switch is held in the first position out of contact or engagement with the first conductor while engaging the base of the voltage source.

To use, the removable protective cap is removed from the housing and the switch is pivoted to the second position to simultaneously engage both the first conductor and the base thus completing the circuit. The removable protective cap may be placed over the housing adjacent the switch to effectively extend the length of the reusable flexibe light.

The invention accordingly comprises the features of construction, combination of elements, and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
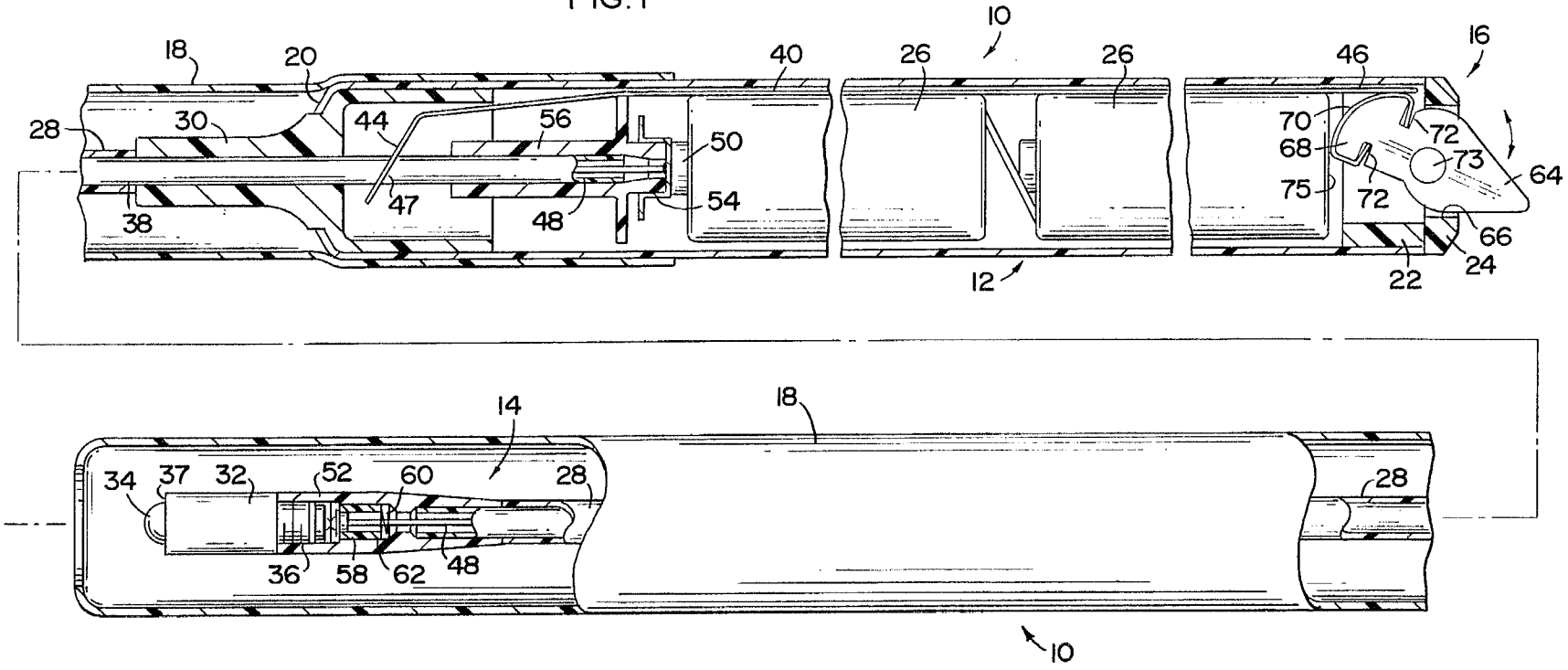
FIG. 1 is a cross-sectional side view of the flexible light.
Figure 2:
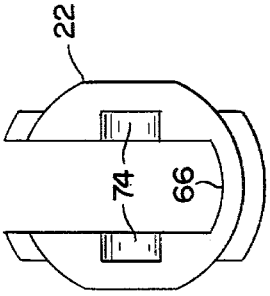
FIG. 2 is an end view of the switch actuator means.

As best shown in FIG. 1, the present invention relates to reusable flexible light generally indicated as 10. The reusable flexible light 10 comprises a hollow substantially cylindrical housing generally indicated as 12 having an extended bulb assembly and switch generally indicated as 14 and 16 respectively mounted at opposite ends thereof. A removable hollow substantially cylindrical protective cap 18 is removably mounted on the housing 12 to protect the extended bulb assembly 14 when the flexible light 10 is not in use.

The hollow substantially cylindrical housing 12 includes a retainer lip 20 and switch retainer comprising a switch housing 22 and a removable retainer cap 24 to operatively couple the extended bulb assembly 14 and switch 16 thereto. A voltage source comprising one or more batteries each indicated as 26 is operatively retained within the hollow substantially cylindrical housing 12.

The extended bulb assembly 14 comprises an enlongated hollow flexible sleeve 28 having a mounting member 30 attached to one end thereof to attach the extended bulb assembly 14 to the hollow substantially cylindrical housing 12 and a bulb housing 32 having a light source 34 disposed therein with a first recess 36 attached to the opposite end thereof. A light source retainer 37 attaches the light source 34 to the bulb housing 32.

A first conductor comprising a first and second conductor element 38 and 40 respectively electrically coupled to the side 42 of the light source 34 extends substantially the entire length of the flexible light. The second conductor element 40 includes a first and second contact 44 and 46 respectively to selectively couple the first conductor element 38 to the switch 16 as more fully described hereinafter. The first contact 44 comprises an aperture 47 disposed in surrounding relation relative to the inner portion of the first conductor element 38.

A second conductor 48 extends between the terminal 50 of the voltage source 26 and the base 52 of the light source 34. The inner end of the second conductor 48 is held in contact with the terminal 50 by a conductor element 54 mounted on a first coupling element 56. The outer end of the second conductor 48 is held in contact with the base 52 by a second coupling element 58 biased outwardly by bias means 60 within a second recess 62.

The switch 16 comprises a body 64 extending through aperture 66, an arcuate cam member 68 and switch contact 70 operatively retained by slots or grooves 72 formed on opposite sides of the arcuate cam member 68. The switch 16 is pivotally mounted within the hollow substantially cylindrical housing by a pair of attachment members 73 extending from opposite sides of the body 64 to be received in recesses 74. As described more fully hereinafter, the switch contact 70 is movable between a first and second position to operatively engage and disengage the second contact 48 to actuate and deactuate the flexible light 10.

The removable protective cap 18 comprises an enlarged inner attachment portion to engage the housing 12 and an elongated outer protective portion.

When not in use, the removable protective cap 18 is mounted onto the hollow substantially cylindrical housing 12 to enclose the extended bulb assembly 14. The switch 16 is held in the first position out of contact or engagement with the second contact 46 while engaging the base 75 of the voltage source 26.

To use, the removable protective cap 18 is removed from the hollow substantially cylindrical housing 12 and the switch 16 is pivoted to the second position to simultaneously engage both the second contact 46 and the base 75 thus completing the circuit from the terminal post 50, second conductor 48 to the base 52 through the light source 34, first and second conductor elements 38 and 40 to second contact 46 and through switch 16 to the base 75. The removable protective cap 18 may be placed over the housing 18 adjacent the switch 16 to extend the effective length of the reusable flexible light 10. The batteries 26 and light source 34 may be replaced by removing the removable retainer cap 24 and removable light source retainer 37 respectively.

It will thus be seen that the objects set forth above, and those made apparent from the preceding description are efficiently attained and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statement of the scope of the invention which as a matter of language, might be said to fall therebetween.

Now that the invention has been described,

I claim:

1. A light comprising an outer housing configured to retain a voltage source therein having an extended bulb assembly mounted within one end thereof, a protective cap removably attached to said outer housing disposed to enclose said extended bulb assembly when said light is not in use, and a switch pivotally mounted on the opposite end thereof, said extended bulb assembly comprises an elongated hollow flexible sleeve disposed within said protective cap when said light is not in use, said extended bulb assembly having a mounting member attached to one end thereof to attach said extended bulb assembly to said outer housing and a bulb housing having a light source at least partially disposed therein attached to the opposite end thereof, a first conductor extending substantially the length of said flexible light coupled to said light source, a second conductor disposed within said elongated hollow flexible sleeve coupled between said voltage source and another portion of said light source, said switch comprising a body including a cam member formed thereon and a switch contact attached to said cam member being pivotally movable between a first and second position to selectively isolate said first conductor from said voltage source when in said first position to deactuate said flexible light and to selectively couple said first conductor to said voltage source to actuate said light when in said second position.

2. The light of claim 1 wherein said first conductor comprises a first conductor element and second conductor element, said first conductor element extending substantially the length of said extended bulb assembly between said light source and said second conductor element, said second conductor element extending substantially the length of said outer housing between said first conductor element and said switch.

3. The light of claim 2 wherein said second conductor element includes a first contact to engage said first conductor element and a second contact to selectively engage said switch when said switch is in said second position.

4. The light of claim 1 wherein said second conductor is held in contact with said voltage source by a first coupling element and with said light source by a second coupling element biased outwardly relative to said outer housing by a bias means.

5. The light of claim 1 wherein said switch comprises a body having a pair of attachment members extending from opposite sides thereof to pivotally mount said switch to said outer housing.

6. The light of claim 1 wherein said switch contact to continuously engage said voltage source and selectively engage said first conductor.

7. The light of claim 1 further including a retainer cap removably disposed within said outer housing to permit selective replacement of said voltage source.

8. The light of claim 1 further including a light source retainer to retain said light source in said bulb housing to permit selective removal and replacement of said light source.

9. The light of claim 1 wherein said protective cap is configured to attach to the end of said outer housing opposite from said extended bulb assembly when said light is in use effectively increasing the length of said light.

* * * * *